US008500300B2

(12) United States Patent
Fang et al.

(10) Patent No.: US 8,500,300 B2
(45) Date of Patent: Aug. 6, 2013

(54) OPTICAL LENS, LIGHT-EMITTING DIODE OPTICAL COMPONENT AND LIGHT-EMITTING DIODE ROAD LAMP

(75) Inventors: Yu-Bin Fang, Tainan (TW); Chi-Feng Lin, Tainan (TW); Po-Hua Yang, Tainan (TW)

(73) Assignee: National Applied Research Laboratories, Taipei (TW)

( * ) Notice: Subject to any disclaimer, the term of this patent is extended or adjusted under 35 U.S.C. 154(b) by 172 days.

(21) Appl. No.: 13/251,645

(22) Filed: Oct. 3, 2011

(65) Prior Publication Data

US 2013/0083521 A1 Apr. 4, 2013

(51) Int. Cl.
*F21V 1/00* (2006.01)

(52) U.S. Cl.
USPC ..... 362/235; 362/311.02; 359/664

(58) Field of Classification Search
USPC ..... 362/235, 311.02, 311.09; 359/664
See application file for complete search history.

(56) References Cited

U.S. PATENT DOCUMENTS 6,296,376 B1 * 10/2001 Kondo et al. ..... 362/310
6,345,903 B1 * 2/2002 Koike et al. ..... 362/241
6,404,131 B1 * 6/2002 Kawano et al. ..... 315/82
6,746,295 B2 * 6/2004 Sorg ..... 445/24
7,280,288 B2 * 10/2007 Loh et al. ..... 359/726
7,473,013 B2 * 1/2009 Shimada ..... 362/327
D620,635 S * 7/2010 Chen et al. ..... D26/124
D625,044 S * 10/2010 Lai et al. ..... D26/124
7,843,654 B2 * 11/2010 Destain ..... 359/794
7,993,035 B2 * 8/2011 Shih et al. ..... 362/311.02
8,007,140 B2 * 8/2011 Zhang ..... 362/311.12
8,011,811 B2 * 9/2011 Shih et al. ..... 362/311.02
8,070,326 B2 * 12/2011 Lee ..... 362/307

* cited by examiner

*Primary Examiner* — Ali Alavi
(74) *Attorney, Agent, or Firm* — Muncy, Geissler, Olds & Lowe, PLLC

(57) ABSTRACT

The invention is related to an optical lens, a light-emitting diode optical component and a light-emitting diode road lamp. The optical lens formed as a semi-spherical shape includes an uplifting spherical surface and a bottom surface corresponding to the spherical surface. The bottom surface includes an elongate recess concave to the spherical surface and formed with an inner surface corresponding to the spherical surface and two vertical side surfaces adjacent to the inner surface. The inner surface of the elongate recess includes a similar Gaussian distribution curve provided on a section parallel to the vertical side surfaces. A focus is contained in a center of the bottom surface. A light-emitting diode is disposed below the focus of the optical lens. The special outline structure of the optical lens can provide a uniform luminance distribution on an illuminating area.

5 Claims, 8 Drawing Sheets

OPTICAL LENS, LIGHT-EMITTING DIODE OPTICAL COMPONENT AND LIGHT-EMITTING DIODE ROAD LAMP

BACKGROUND OF THE INVENTION

1. Field of the Invention

The present invention relates to an optical lens, a light-emitting diode optical component and a light-emitting diode road lamp, and in particular relates to an optical lens capable of scattering the light into a rectangular illuminating area with a uniform luminance distribution, and a light-emitting diode optical component and a light-emitting diode road lamp which are equipped with the optical lens.

2. Description of the Related Art

Conventional mercury road lamps, the same as general lamps, are capable of providing a distribution of rounded radiant illumination region, but the rounded illumination region cannot provide a rectangularly extended pavement with a uniform radiant illumination. Therefore, it is understood that a preferable illumination type of the road lamp shall be able to provide a rectangular illumination region with a uniform illumination distribution in accordance to the shape of the pavement and to increase the illumination utilization efficiency.

With the developing of light-emitting diode (LED) technologies in recent years, LED illumination industries have developed accordingly. In illumination industries, due to the high-directional radiant of the LEDs, it is necessary to utilize a secondary optics lens to alter the light path to obtain a uniform scattered light.

Therefore, based on the road illuminating requirement and the illuminating properties of the LEDs, several LED lenses for the road illuminating have been developed.

U.S. Pat. No. 7,618,163 discloses a light-directing LED apparatus for the road illuminating. However, the optical lens of '163 case has a complicate structure and is difficult to be produced, and it can be seen that the luminance distribution in FIG. 20 of the specification is not provided with an ideal rectangular distribution.

Further, in U.S. Pat. No. 7,766,509 and Taiwan Patent Nos. M394532, M395836, M395097, M388004 or M380480, several symmetrical or asymmetrical LED lens for the road lamp are developed in accordance with the illuminating requirement of the LED road lamp.

BRIEF SUMMARY OF THE INVENTION

The present invention provides an optical lens with a free surface different from that of the related arts and a light-emitting diode (LED) optical component equipped with the optical lens. The optical lens enables the LED optical component to produce a rectangular illumination area with a uniform luminance distribution for the road illuminating. Thus, the present invention further provides a LED lamp.

The present invention provides an optical lens formed as a semi-spherical shape, comprising an uplifting spherical surface, a bottom surface corresponding to the spherical surface and a focus located at a center of the bottom surface, wherein the bottom surface includes an elongate recess concave to the spherical surface and formed with an inner surface corresponding to the spherical surface and two vertical side surfaces adjacent to the inner surface, and the inner surface of the elongate recess includes a curve provided on a section parallel to the vertical side surfaces and symmetrically distributed relative to a center point, to form a first curvature section gradually extended and concave to the spherical surface and a second curvature section smoothly connected to the first curvature section and concave to the elongate recess and to form the curve as a similar Gaussian distribution curve.

The present invention also provides a light-emitting diode optical component, comprising the optical lens and a light-emitting diode disposed below the focus of the optical lens.

The present invention also provides a light-emitting diode road lamp using the light-emitting diode optical component, comprising a plurality of light-emitting diode optical components arranged in matrix and connected therebetween.

Further, the light-emitting diode optical components are arranged on a lamp seat.

Further, the optical lens of the light-emitting diode optical component is integrally formed on a connection plate.

The present invention provides the following effects. In the light radiation field, the optical lens of the present invention enables the high-directional LED to scatter the light into a uniform rectangular illuminating area with a uniform luminance distribution therethrough. Further, the LED road lamp of the present invention is intended for a rectangularly extended pavement, capable of providing high illumination utilization efficiency.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of an optical lens, a light-emitting diode (LED) optical component and a light-emitting diode (LED) road lamp of the invention and should not be taken in a limiting sense. The scope of the invention is best determined by reference to the appended claims.

Figure 1:
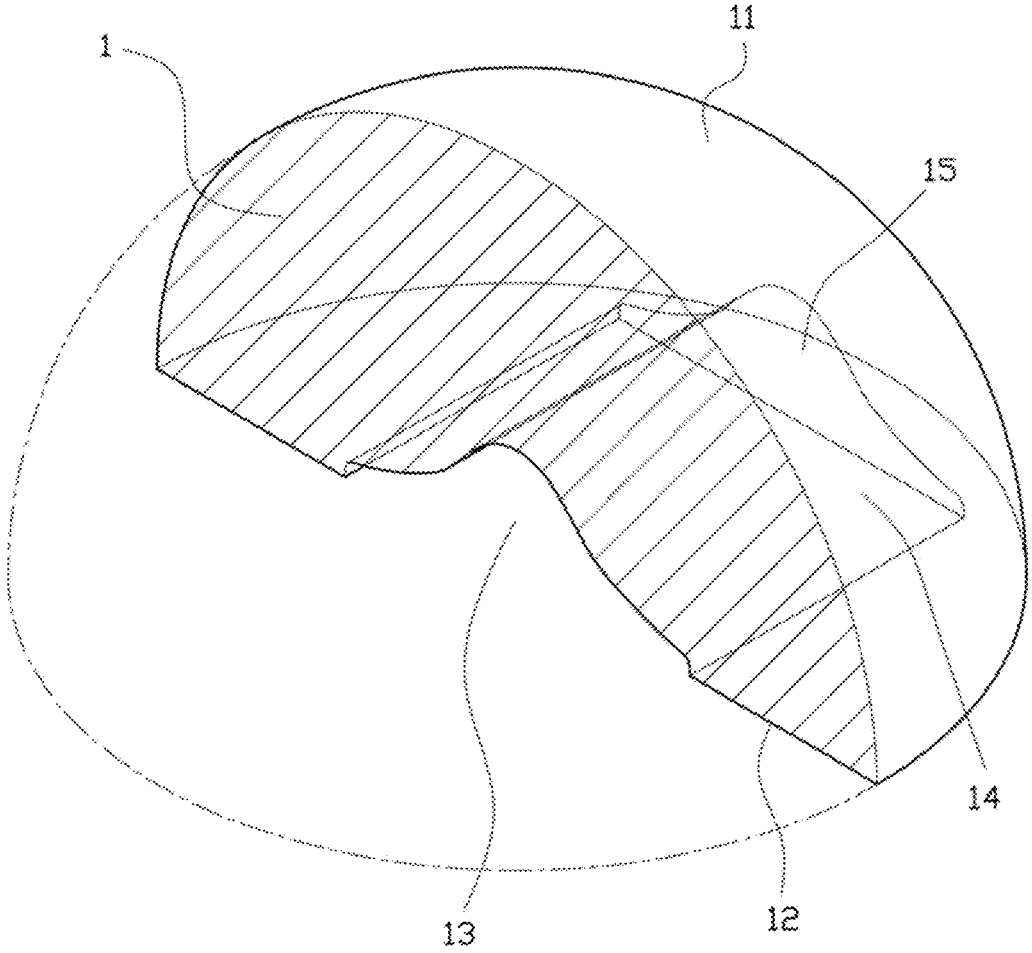
FIG. 1 is a schematic view of an optical lens of the invention.
Figure 2:
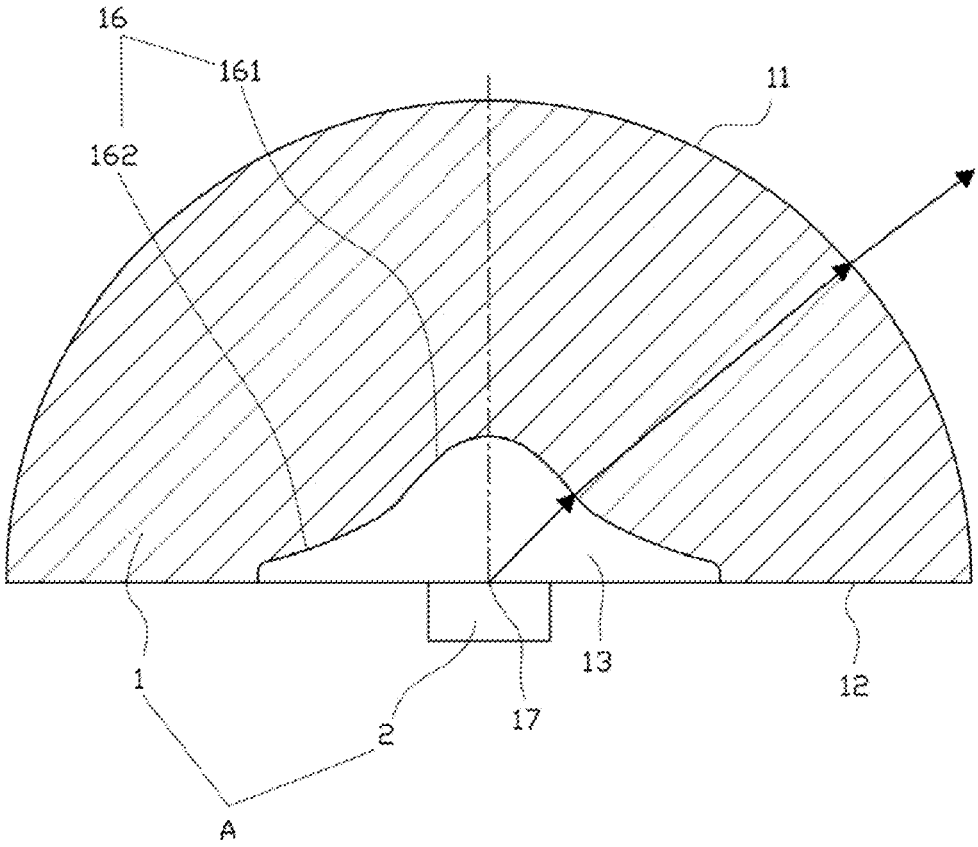
FIG. 2 is a schematic view showing a section parallel to a vertical side surface of a light-emitting diode optical component of the invention.
Figure 3:
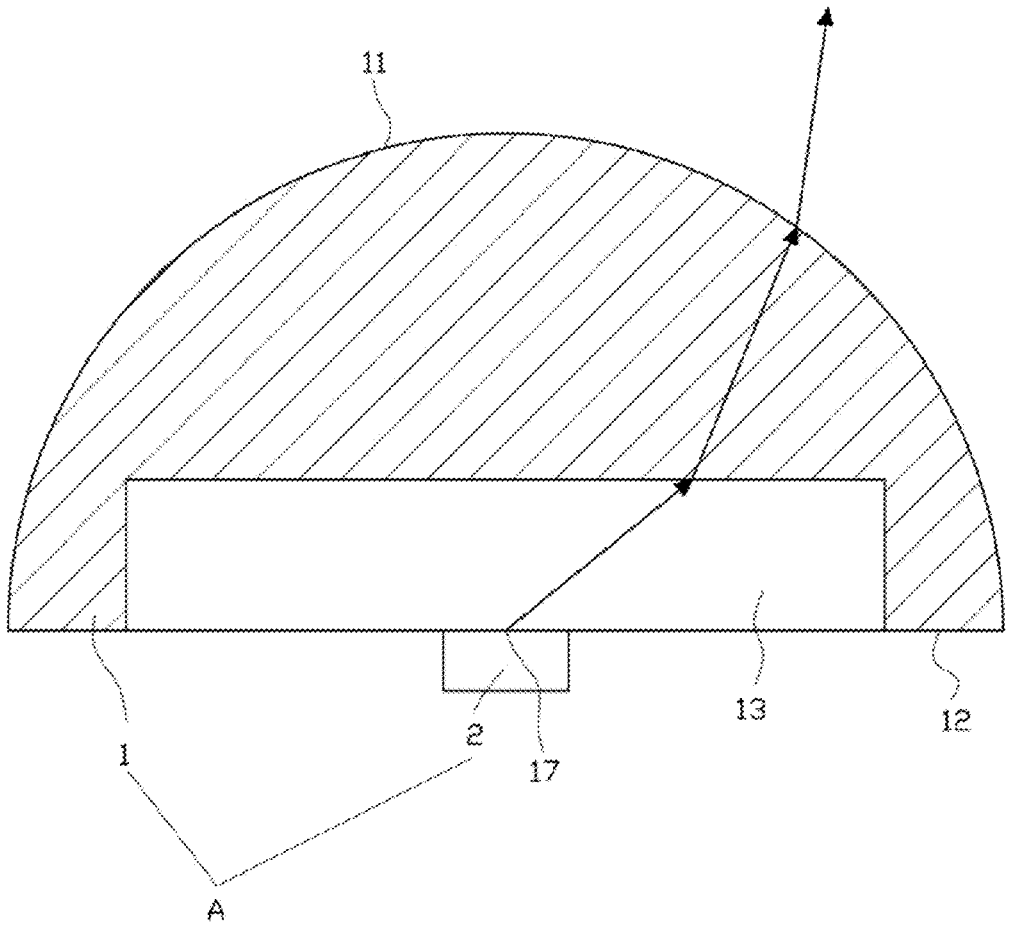
FIG. 3 is a schematic view showing a section perpendicular to a vertical side surface of a light-emitting diode optical component of the invention.

Referring to FIGS. 1, 2 and 3, a LED component comprises an optical lens 1 and a LED 2 bonded to the optical lens 1. The optical lens formed as a semi-spherical shape comprises an uplifting spherical surface 11, a bottom surface 12 corresponding to the spherical surface 11, and a focus 17 located at a center of the bottom surface 12, wherein the bottom surface 12 includes an elongate recess 13 concave to the spherical surface 11 and formed with an inner surface 14 corresponding to the spherical surface 11 and two vertical side surfaces 15 adjacent to the inner surface 14, and the inner surface 14 of the elongate recess 13 includes a curve 16 provided on a section parallel to the vertical side surfaces 15 and symmetrically distributed relative to a center point, to form a first curvature section 161 gradually extended and concave to the spherical surface 11 and a second curvature section 162 smoothly connected to the first curvature section 161 and concave to the elongate recess 13 and to form the curve 16 as a similar Gaussian distribution curve. The LED 2 is disposed below the focus 17 of the optical lens 1.

Figure 4:
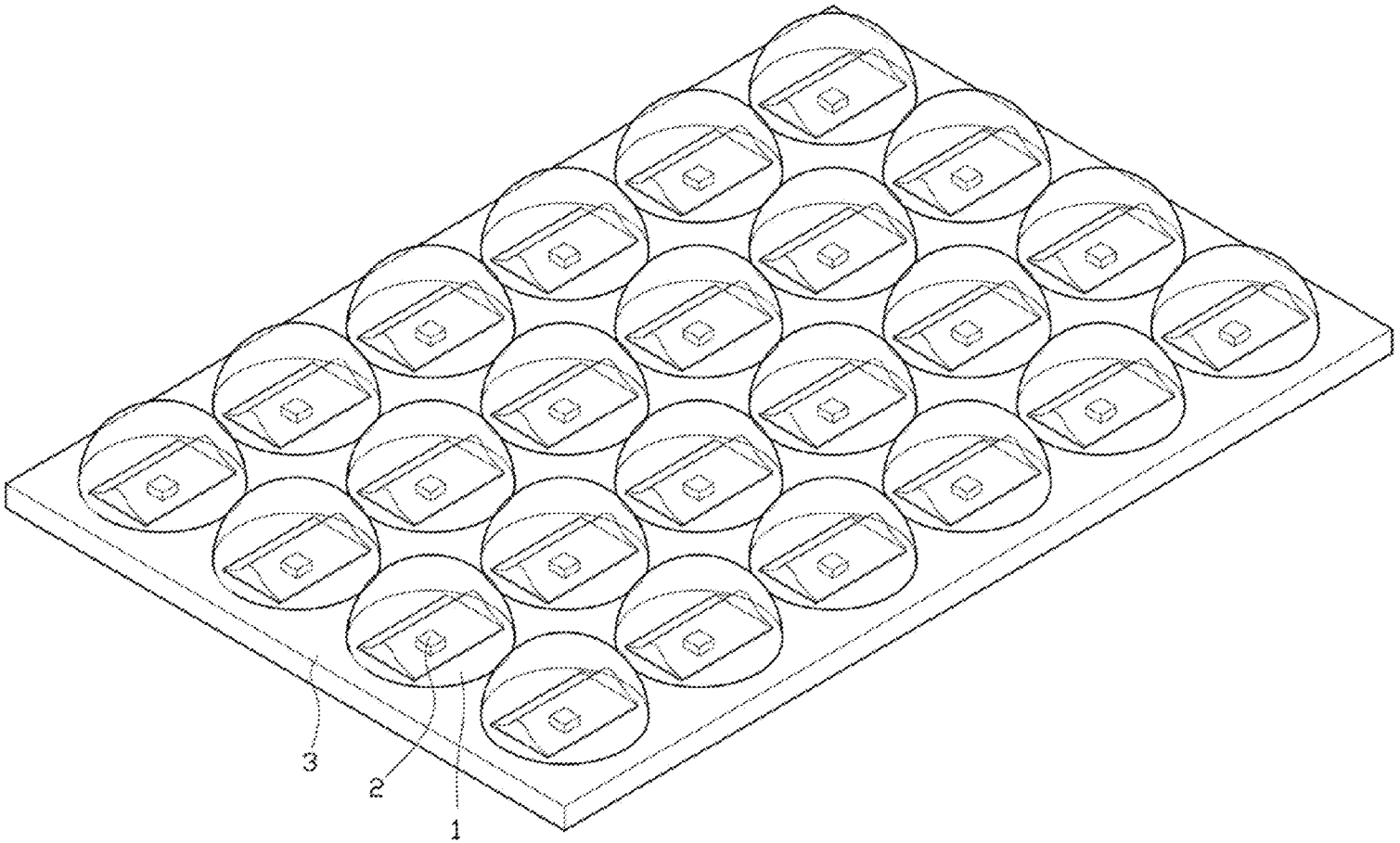
FIG. 4 is a schematic view of a light-emitting diode lamp of the invention.
Figure 5:
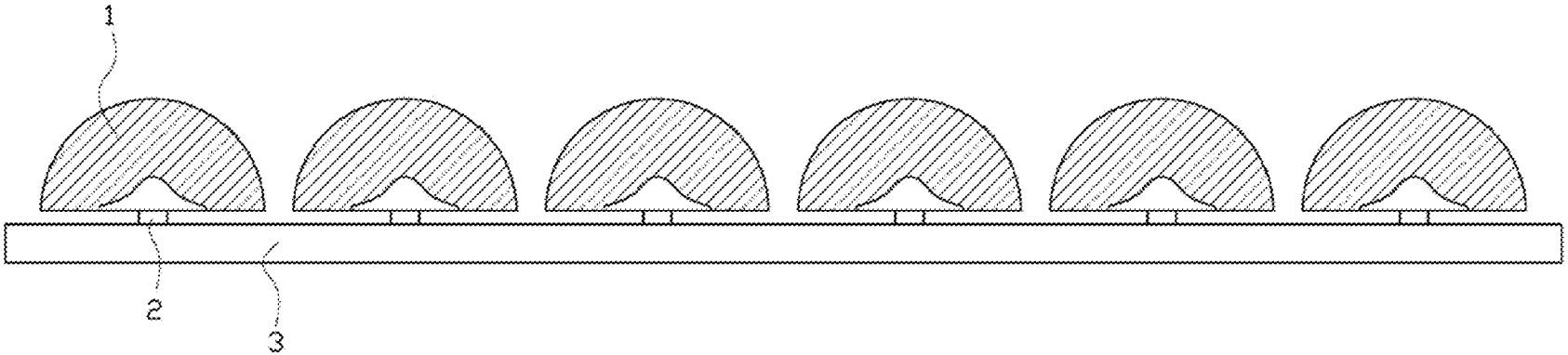
FIG. 5 is a schematic view showing an optical lens of a light-emitting diode lamp bonded to a lamp seat of the invention.
Figure 6:
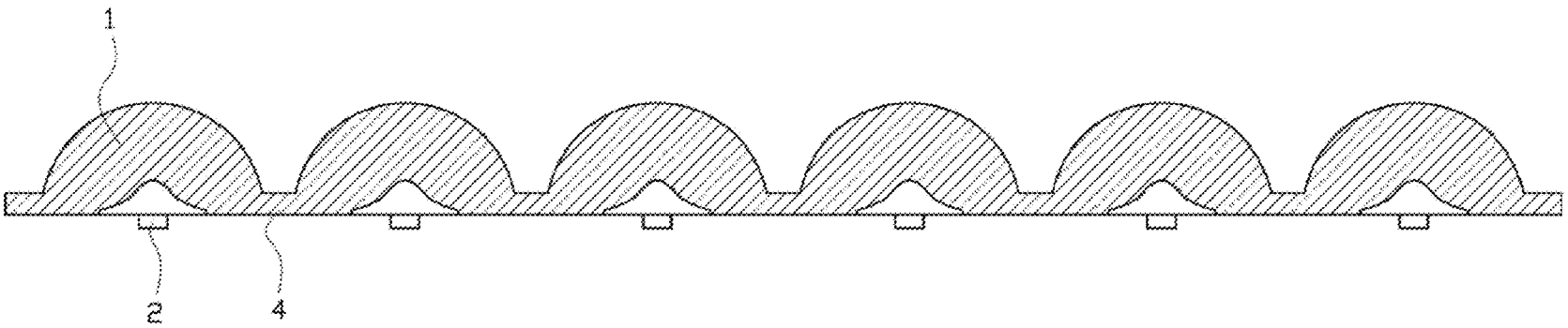
FIG. 6 is a schematic view showing an optical lens of a light-emitting diode lamp integrally formed on a connection plate of the invention.

Referring to FIG. 4, the LED road lamp comprises a plurality of LED components 'A' arranged in matrix and connected therebetween. Referring to FIG. 5, the LED components 'A' are arranged in matrix on a lamp seat 3. Referring to FIG. 6, the optical lens 1 of the LED optical component 'A' is integrally formed on a connection plate 4, thereby simplifying the manufacturing process.

Figure 7:
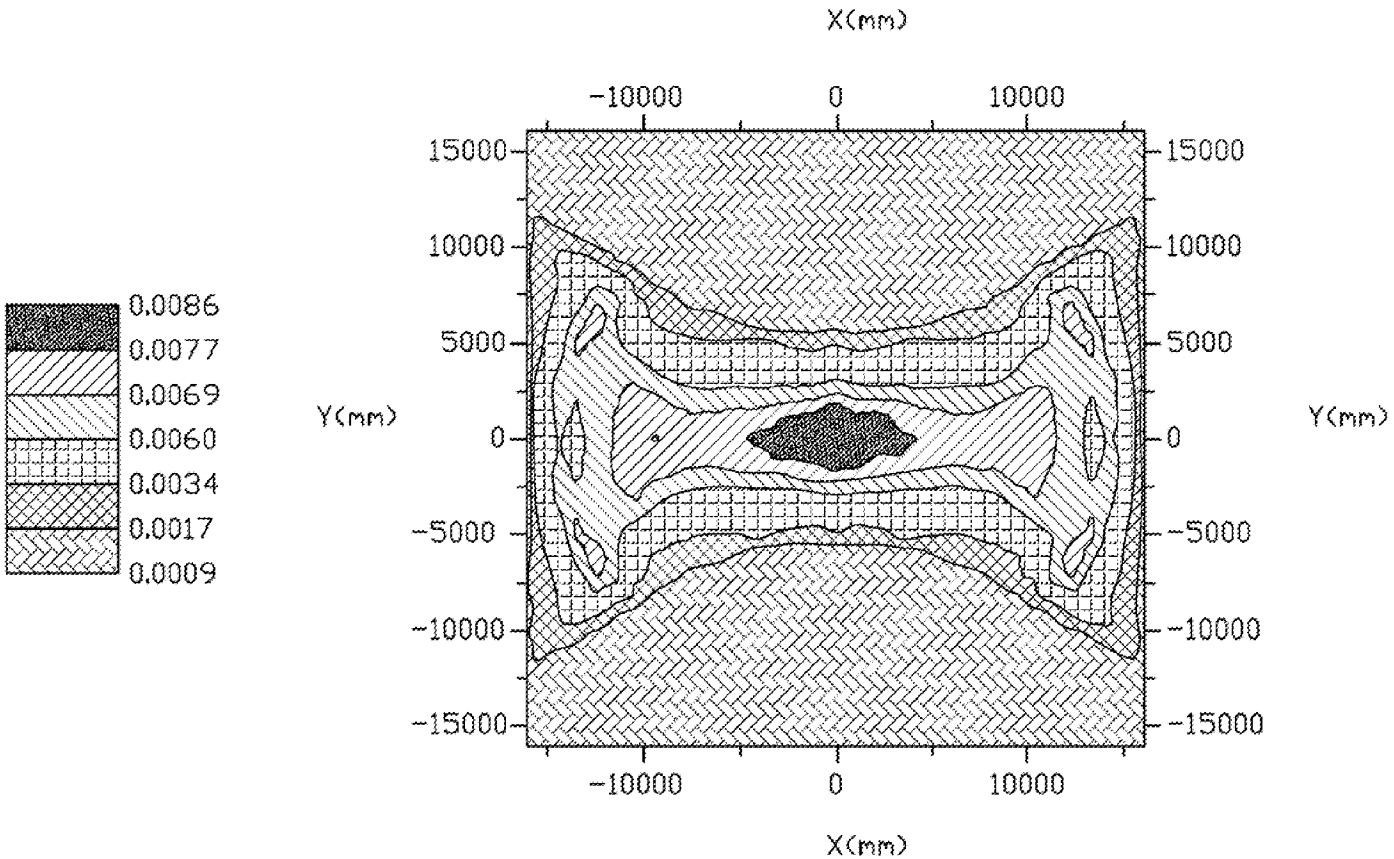
FIG. 7 shows a numerical analytical simulation diagram of the luminance of a light-emitting diode optical component of the invention.
Figure 8:
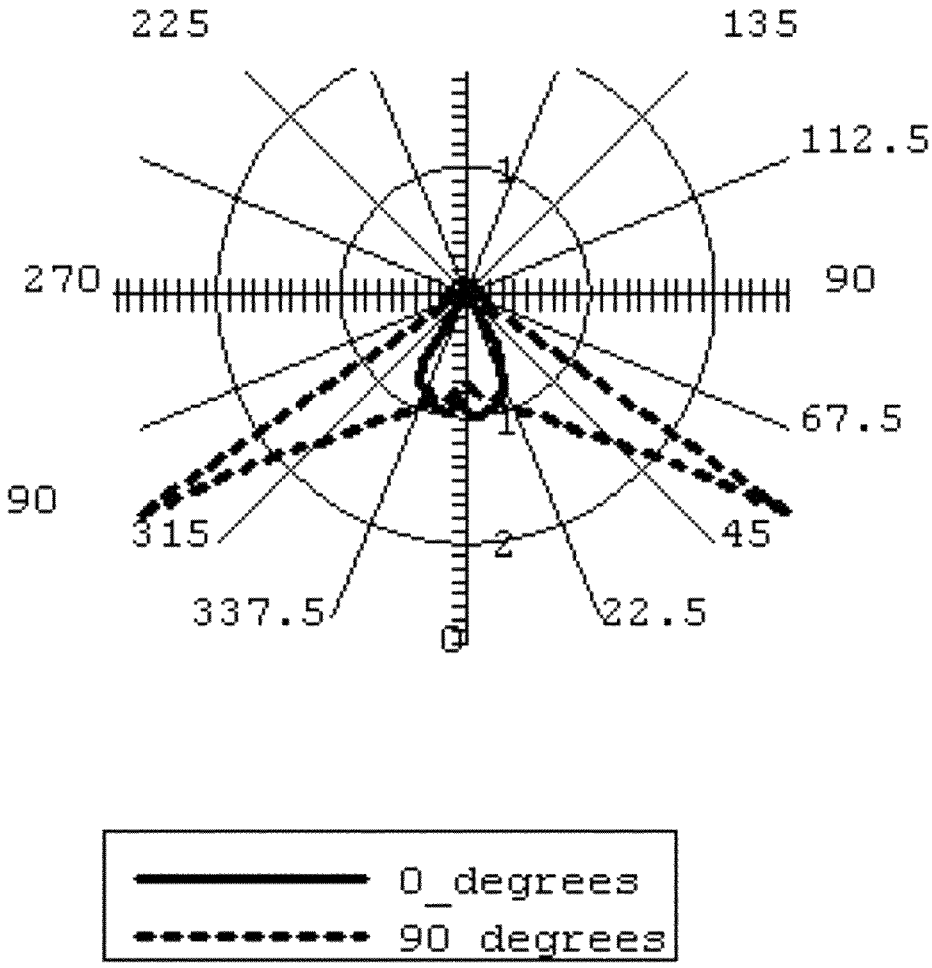
FIG. 8 shows a light distribution curve diagram of a light-emitting diode optical component of the invention.

FIG. 7 shows a numerical analytical simulation diagram of the luminance of the LED optical component 'A' of the invention and FIG. 8 shows a light distribution curve diagram of the LED component 'A' of the invention. The LED component of the invention is imported in optical simulation software to proceed light tracing. In FIGS. 7 and 8, it is understood that a luminance distribution of the rectangular illuminating area represented by a dotted square frame is suitably intended for the road illuminating.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An optical lens formed as a semi-spherical shape, comprising an uplifting spherical surface, a bottom surface corresponding to the spherical surface and a focus located at a center of the bottom surface, the bottom surface including an elongate recess concave to the spherical surface and formed with an inner surface corresponding to the spherical surface and two vertical side surfaces adjacent to the inner surface, the inner surface of the elongate recess including a curve provided on a section parallel to the vertical side surfaces and symmetrically distributed relative to a center point, to form a first curvature section gradually extended and concave to the spherical surface and a second curvature section smoothly connected to the first curvature section and concave to the elongate recess and to form the curve as a similar Gaussian distribution curve.

2. A light-emitting diode optical component, comprising:

an optical lens formed as a semi-spherical shape, comprising an uplifting spherical surface, a bottom surface corresponding to the spherical surface and a focus located at a center of the bottom surface, the bottom surface including an elongate recess concave to the spherical surface and formed with an inner surface corresponding to the spherical surface and two vertical side surfaces adjacent to the inner surface, the inner surface of the elongate recess including a curve provided on a section parallel to the vertical side surfaces and symmetrically distributed relative to a center point, to form a first curvature section gradually extended and concave to the spherical surface and a second curvature section smoothly connected to the first curvature section and concave to the elongate recess and to form the curve as a similar Gaussian distribution curve; and a light-emitting diode disposed below the focus of the optical lens.

3. A light-emitting diode road lamp using the light-emitting diode optical component as claimed in claim 2, comprising a plurality of light-emitting diode optical components arranged in matrix and connected therebetween.

4. The light-emitting diode road lamp as claimed in claim 3, wherein the light-emitting diode optical components are arranged on a lamp seat.

5. The light-emitting diode road lamp as claimed in claim 3, wherein the optical lens of the light-emitting diode optical component is integrally formed on a connection plate.

* * * * *